United States Patent [19]

Beaver

[11] Patent Number: 4,743,477

[45] Date of Patent: May 10, 1988

[54] OPTICAL NOVELTY SIMULATING A CONTAINERIZED RAINBOW

[76] Inventor: Warren R. Beaver, 34 Second St. W., Kalispell, Mont. 59901

[21] Appl. No.: 29,544

[22] Filed: Mar. 24, 1987

[51] Int. Cl.[4] ..... B44F 1/04; B44F 9/00

[52] U.S. Cl. ..... 428/13; 272/15; 428/15; 428/38

[58] Field of Search ..... 272/15, 1 R, 8 R, 8 N, 272/8 D; 428/13, 15, 35, 38

[56] References Cited

U.S. PATENT DOCUMENTS

| | | | |
|---|---|---|---|
| 249,676 | 11/1881 | Ripley | 428/13 |
| 1,787,371 | 12/1930 | Heaton | 428/119 |
| 2,252,821 | 8/1941 | Thompson | 428/13 X |
| 2,730,827 | 1/1956 | Patterson | 428/13 X |
| 2,793,148 | 5/1957 | West | 428/38 |
| 2,887,806 | 5/1959 | Hassett | 428/46 |
| 3,268,379 | 8/1966 | Baker | 428/38 X |
| 4,002,333 | 1/1977 | Gotoh | 272/8 D |
| 4,057,921 | 11/1977 | Ball | 428/13 X |
| 4,395,835 | 8/1983 | Schneider | 40/581 X |
| 4,403,004 | 9/1983 | Parker et al. | 156/244.27 X |
| 4,425,602 | 1/1984 | Lansing | 362/102 X |
| 4,500,374 | 2/1985 | Nakazima | 156/83 |
| 4,576,839 | 3/1986 | DiVincenzo | 428/16 X |

FOREIGN PATENT DOCUMENTS

| | | | |
|---|---|---|---|
| 1155038 | 9/1963 | Fed. Rep. of Germany | 428/38 |
| 308073 | 3/1929 | United Kingdom | 428/38 |
| 596323 | 1/1948 | United Kingdom | 428/38 |

*Primary Examiner*—Henry F. Epstein

*Attorney, Agent, or Firm*—Keith S. Bergman

[57] ABSTRACT

An article of manufacture providing a bottle-like translucent cylinder defining a chamber containing a rainbow element that when viewed with transmitted light has the appearance of a rainbow within the container. The rainbow element is formed of a plurality of arcuately shaped, translucent colored glass bands, arrayed with rainbow simulating colors, in intimate intercommunicating relationship and positionally maintained in the chamber of the container at a spaced distance from its sides.

7 Claims, 1 Drawing Sheet

OPTICAL NOVELTY SIMULATING A CONTAINERIZED RAINBOW

II. BACKGROUND OF INVENTION

IIA. Related Applications

There are no applications related hereto heretofore filed in this or any foreign country.

IIB. Field of Invention

My invention generally relates to optical novelties and more particularly to such a device that simulates a containerized rainbow.

IIC. Description of Prior Art

Since times immemorial mankind has been fascinated with rainbows and much mysticism and folklore has grown up about them. Vestiges of these primordial emotions have survived in modern man so that the rainbow and its simulations still present a desirable ascetic experience. Because of the ephemeral nature of the actual rainbow, the asceticism associated with it is even enhanced by its containerization, since that in the experience of reality is an impossibility. The instant invention seeks to provide an optical novelty item to satisfy and fulfill these latent primordial ascetic desires in modern man.

It has heretofore become known to associate a plurality of pieces of colored glass in adjacent spacial array so that they might be viewed by transmitted light to present an ascetically pleasing pattern or picture. In so doing it has also heretofore been learned that the spaces or matrix between pieces of colored glass must either be non-existent or filled with light opaque material in order to present to a viewer a continuously colored pattern without interspersed areas of ordinary clear, completely admixed light. In general, this knowledge has heretofore been used to present to a viewer colored images that would simulate pictures or designs, such as in stained glass panels of various sorts.

It appears that such optical creations have not in general provided translucent elements, that are not transparent, on both sides of a colored glass panel. It has become known to associate clear panels of one sort or another with colored glass panels, commonly on one side but occasionally on both sides, to provide physical protection for such colored glass panels. The desired effect, however, is to provide protection and in general to maintain the visual imagery of the colored glass panel as clearly as possible so that that panel may be readily observable not only by transmitted light but also by reflected light to maintain integrity of a picture or design simulated thereby. Again, such prior art has shown panels on one or both sides of a colored glass panel generally has not presented the imagery of a rainbow, probably because to do so with the existing art, the structure would be shown in detail and the ascetic mystical, magical effect commonly associated with vestiges of primordial psychology would be lost.

My invention seeks to present a colored glass panel that simulates the colors and shape of a rainbow but yet is carried within a translucent cylindrical container that is not transparent. This type of containment, no matter how the device be viewed, presents a translucent surface on both sides of a colored glass panel, relative to a viewer. This optical arrangement when viewed by transmitted light provides a translucent light scattering surface between the light source and the colored glass panel and also present a similar diffusing surface between the transmitted light from that panel and the viewer, all to make the structural details of the colored glass panel relatively indistinct to an ultimate viewer and present to him an image of ascetic appealability that substantially simulates the ephemeral affects of a natural rainbow. In addition the container, at least as to its peripheral surface, is obvious to the viewer so as to present the imagery that whatever is presenting the rainbow image is contained and thus by similitude conveying to the ultimate viewer the concept that the rainbow he is viewing is contained.

In the prior art in what few instances exist of simulating a rainbow or rainbow-like configuration, in general a relatively limited number of translucent or transparent colored glass elements have been provided. My invention allows the provision of a larger number of such elements depending upon the degree of optical perfection desired. In general, however, I have found five to ten such elements provide a quite finely simulated rainbow image of a nature almost immeasurably different from prior art simulations because of the other elements of my device.

My invention resides not in any one of the structures described per se but rather in the synergistic combination of all of them to provide the functions and results necessarily flowing therefrom.

III. SUMMARY OF INVENTION

My invention in general provides a cylindrical bottle-like container having a structurally joined bottom and a fastenable top. The container is rendered translucent by a frosted interior surface that causes diffusion of light passing therethrough. I provide a sheet-like translucent colored glass structure, that comprises a plurality of similar arcuately shaped elements of colored glass formed and arrayed somewhat as a natural rainbow, to fit within the chamber of such container. The colored glass elements structurally intercommunicate so as not to allow the passage of light between their adjacent peripheries. This colored glass structure is fastened in a vertical position in the container to extend substantially between the top and bottom thereof. The container is normally permanently sealed once it is properly finished.

In creating such a device, it is:

A principal object of my invention to provide an optical novelty item that simulates to a viewer an image of a natural rainbow contained in a bottle.

A further object of my invention to provide such a device that has translucent, light disseminating elements on both sides of a colored glass panel, especially to diffuse light passing through the panel toward a viewer so as to conceal the structural details of the image forming elements within the container.

A further object of my invention to provide such a device that has a colored glass panel formed of a plurality of similar arcuately shaped colored glass elements arrayed in adjacency in a plane with colors simulating the colors of a rainbow.

A still further object of my invention to provide such colored glass panel that has its elements structurally joined in adjacency to prevent light being transmitted between the peripheries of adjacent elements.

A still further object of my invention to provide such a device that is of new and novel design, of rugged and durable nature, of simple and economic manufacture and one otherwise well suited to the uses and purposes for which it is intended.

Other and further objects of my invention will appear from the following specification and accompanying drawings which form a part hereof.

In carrying out the objects of my invention, however, it is to be understood that its essential features are susceptible of change in design and structural arrangement with only one preferred and practical embodiment being illustrated in the accompanying drawings as is required.

IV. BRIEF DESCRIPTION OF THE DRAWINGS

In the accompanying drawings which form a part hereof and wherein like numbers of reference refer to similar parts throughout;

V. DESCRIPTION OF THE PREFERRED EMBODIMENT

Figure 1:
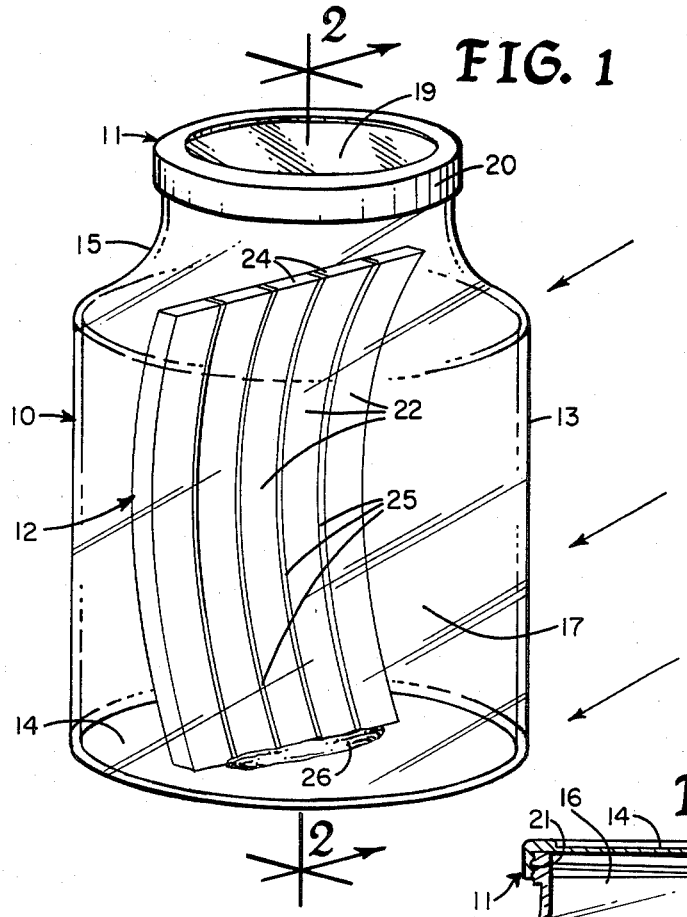
FIG. 1 is an isometric surface view of my invention showing its various parts, their configuration and relationship.
Figure 2:
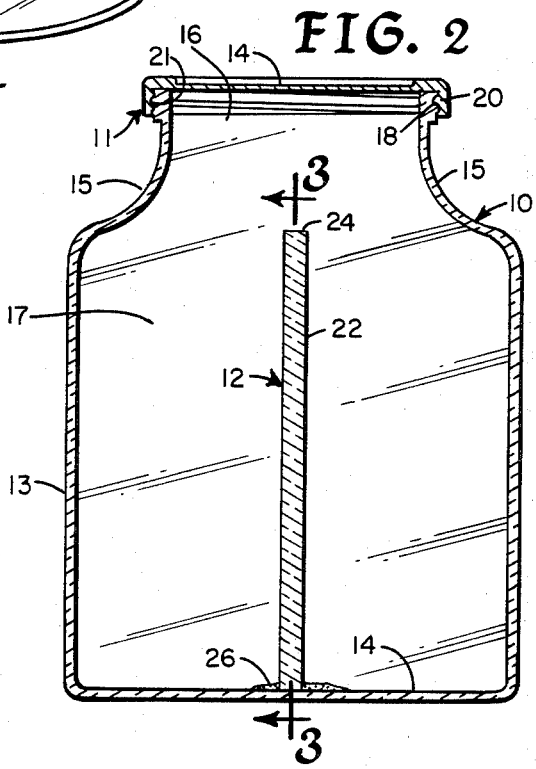
FIG. 2 is a vertical diametrical cross-sectional view through the device of FIG. 1, taken on the line 2—2 thereon in the direction indicated by the arrows.
Figure 3:
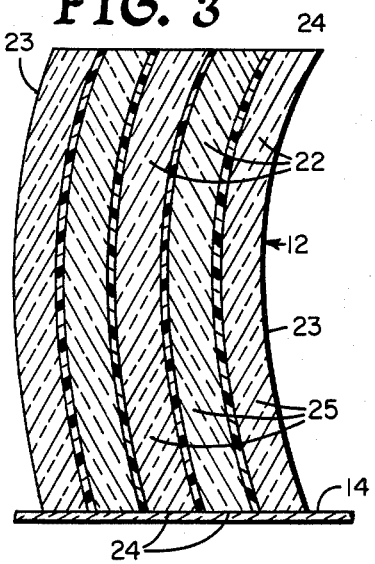
FIG. 3 is a partial cross-sectional view through the colored glass panel of my invention, taken on the line 3—3 of FIG. 2 in the direction indicated by the arrows thereon.

My invention generally comprises cylindrical container 10 closed by top 11 and carrying colored translucent panel 12 in its internal chamber.

Container 10 is a bottle-like structure peripherally defined by cylindrical side 13 structurally communicating with bottom 14 in its lowermost part and transition portion 15 defining top orifice 16 in its upper part. These various peripheral portions cooperate to define internal chamber 17. Cylindrical side element 13 preferably defines a substantially vertical surface when bottom 14 be positioned for support on an underlying horizontal supporting surface. Top orifice 16 allows positioning of panel element 12 within container chamber 17. Normally the size of this orifice is such as to allow the passage of the assembled panel but the panel could be assembled within the container chamber and passed through a smaller orifice, if desired.

The configuration of transition element 15 is not critical so long as it provides a transition surface between the upper part of cylindrical side 13 and top orifice 16. The particular shape and configuration of the elements illustrated are of a circular cross-section but this shape is not essential to my invention and various other cross-sectional shapes that define closed curves may serve its purposes. The sizing of the various elements of my container similarly is not critical in absolute value, though the various parts must be sized proportionately to serve the purposes illustrated and specified. The thickness of the peripheral walls of container 10 again is not critical but normally will be in the range of ordinary manufacturing standards, from $\frac{1}{8}$ to $\frac{1}{4}$ inch in a device of approximately the size illustrated, to provide appropriate strength and durability.

The upper outer surface of transition element 15, immediately adjacent that portion that defines top orifice 16, in the instance illustrated is provided with external threads 18 to aid in fastening top 11 to the container. This method of top fastening is not essential, however, and other known methods may be used that accomplish the same purposes. In fact, if desired, the top may be permanently fixed and sealed to the container after manufacture of the device by adhesives or by welding if both pieces be formed of appropriately compatible glass material.

Container 10 is formed from a light translucent material that diffuses or scatters light rays passing therethrough. Preferably the container is formed of glass and is made translucent by creating an irregular surface on its interior surface, such as by sand blasting. Such a so-called "frosted" surface serves the purpose both of making the container translucent and of appropriately scattering light rays that pass therethrough. The fineness of the size of the protuberances and cavities forming the frosted surface will determine to some degree the amount of translucency of the container and also the amount of its light scattering characteristics. The container may be formed of materials other than glass that would fulfill the purposes aforesaid, though glass is preferred because of its generally better optical characteristics and greater strength and rigidity then those same characteristics of other materials. Some of the more dense, harder plastics may have properties somewhat similar to glass and may be used in substantially the same fashion. These plastic materials in general, however, are not so economical as glass and often are more difficult to properly frost.

Top member 11 provides disk-like top element 19 structurally communicating with rim sturcture 20 depending from its periphery to aid fastening of the top member to container 10. In the instance illustrated, rim 20 is sized and configured to fit immediately outwardly adjacent threads 18 defined in the upper periphery of the container member and defines internal threads 21 adapted to threadedly engage with threads 18 of the container. This top element may be optically opaque or frosted as the other surfaces of container 10 but should not be transparent. Commonly the top structure will be similar to that shown to simulate to a viewer a normal jar lid to further the illusion of a contained rainbow.

The top member may be releasably attached to container 10 as illustrated, or if desired, it may be permanently attached by known means of the container arts. In fact if desired, it could be formed of translucent glass and heat sealed to container 10, if that container be formed of compatible glass, but this structure is not particularly desirable because it does not so well further the illusion of a containerized rainbow and a translucent top tends to admit light into the container chamber from above which tends to lessen the intensity of the rainbow image when viewed through the side of the container.

Colored translucent panel 12 is a planar sheet-like member formed of a plurality of similarly shaped elongate arcuate pieces of colored glass 22 each having elongate sides 23 that fit immediately adjacent a similar side of an adjacent glass element end. Edges 24 of each glass element, in the form illustrated, are substantially coplanar to form a linear top and bottom. The end shapes are not particularly critical but they preferably are such as to conform somewhat to the inner contour of the bottom and top of container 10 so that the panel may be easily fastened to the container by mechanical means.

The exact shape of each of the colored glass strips 22 is not particuarly critical but preferably the distance between their two ends 24 will be about the same as the height of the vertical side of container 10 and their width, that is the dimension between arcuate sides 23, will be such as to allow five or more of such strips to be positioned in side to side adjacency and yet be contained within chamber 17 defined by container 10. Neither the arcuate shape nor any exact degree of curvature are critical but both tend to better simulate the appearance of a rainbow. A curvature related to panel size, similar to that illustrated, is preferred to better simulate the rainbow illusion. The colored glass strips are chosen from colors approximating those of the natural rainbow, generally ranging from a red on the side of greatest curvature to a violet-blue on the side of least curvature, with the various other colors of the spectrum in ordered array therebetween. Most viewers, however, do not know the natural order of colors in a rainbow and various other arrays may be used, if not so effectively. Normally an array of about five to eight colors is sufficient to present a visual image well simulating an actual rainbow because of the optical nature of my device.

The several strips 22 of colored glass are positioned in side to side adjacency in the desired array and are structurally joined, each to its adjacent member, by adhesion of cohesive matrix material 25. This matrix material should be of a light-opaque nature to prevent light from passing between the several elongate glass strips, as if it does so the optical image of a natural rainbow will be substantially lessened, if not destroyed. This matrix material may be chosen from opaque optical adhesives heretofore known and commonly is a polymeric material of the acrylic or butylnitral type carrying an opaque filler. Preferably the strip of matrix material between adjacent surfaces of colored glass strips is substantially less in dimension then the similar dimension of either of those colored glass strips, as if the opaque area be too great it will destroy the brightness of a rainbow image emanating from my structure and in fact, may even destroy the rainbow essence itself.

Colored glass panel 12 is arrayed so it extends vertically in chamber 17 defined by container 10 and is interconnected to the container by supportive adhesive material 26 to provide a structural communication maintaining this positioning. The attachment is illustrated at the panel bottom, but it may be elsewhere, and especially at the top if desired. Adhesive material 26 may be of the common types presently used in modern day optical commerce to join two glass elements to each other, again commonly a polymeric adhesive material of one sort or another such as an acrylic or epoxy material. The adhesive preferably should have some reasonable permanence and durability to lend those qualities to my completed article, as the article becomes ineffective if the positioning of panel 12 be not substantially maintained. Panel 12 should be substantially medially positioned within container 10 with a spaced distance between the inner surface of the container and the panel periphery at all points except where attached. The nearer the panel is to the geometrical medial position within container 10, the better the device simulates the illustion of a rainbow image to a viewer.

Having thusly described the structure of my device, its operation may be understood.

A device formed according to the foregoing specification is placed between a viewer and a source of light, preferably with an orientation such that the surface of colored translucent panel 12 is substantially perpendicular to a line between the viewer, container 10, and a light source on the far side of the container from the viewer. In this position light rays will pass from the far side of the container, through the container wall furthest from the viewer, thence through colored panel 12 and through the container wall nearest the viewer, to ultimately present a direct optical image to the eyes of the viewer.

As this occurs the light rays will be somewhat diffused as they enter the far side of container 10 by reason of the frosted inner surface so that even if such rays are reasonably columnated, their columniation will be somewhat disturbed and they will not create a completely clear and coherent image of translucent panel 12 as they pass therethrough. After the rays have passed through the translucent panel and through the container side nearest a viewer, the image is again diffused by the frosted inner surface of the container, so that the image ultimately existing externally of the container is not a completely clear image but rather one sufficiently diffused that edges of objects tend to blend with each other and the rainbow-like pattern produced tends to appear to have the continuous color graduation of a natural rainbow. It is to be further noted in this regard that by reason of the curvature of container 10 at the veritcal edge portion of the translucent panel, light will tend to be more diffused and more refracted, by reason of the geometry involved, to additionally enhance the imagery of a natural rainbow and its containment.

Optically the exact nature of the diffusing frosted inner surface of container 10 is not too critical to my invention and most diffusing surfaces will be operative to a greater or lesser degree. I prefer to use glass for container 10 and create the frosted surface by sand blasting that surface with ordinary apparatus known for such purposes using sand of approximately 10 mesh and continuing the blasting until a uniform appearing surface is produced.

The exact optical nature of the colored material from which panel 12 is formed is not particularly critical so long as it pass light and filter that light to the appropriate rainbow colors. I prefer, however, to form the panel from pieces of colored glass of the ordinary commerical type, preferably with a somewhat irregular surface, to provide some additional diffusion and refraction for light passing therethrough. The vertical surfaces of the glass panels might be sand blasted to cause further light diffusion, but in geenral I have found this not to be necessary. The thickness of the glass panel is not critical and normally the ordinary thicknesses of commercially available colored glass quite well serves the purposes of my device.

It is to be noted from the foregoing description that my invention provides not only containment of the image forming translucent panel but also provides light diffusing screens on both sides thereof, at a spaced distance from the adjacent surfaces of the panel. This structure is an essential element of my invention to provide a well simulated image of a rainbow in the fashion described.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. An article of manufacture that optically simulates a containerized rainbow, comprising, in combination:

a peripherally defined cylindrical container having a top and a bottom to define an enclosed chamber, said cylindrical container being formed of light transmitting material and having at least one surface that diffuses light passing therethrough;

a planar panel, formed of structurally joined strips of translucent light filtering material to produce rainbow colors, carried and extending vertically within the container chamber said panel passing no light therethrough except through the light filtering elements.

2. The invention of claim 1 wherein:

the container is formed of glass and the inner surface of the container is translucent by reason of irregularities created therein by sand blasting.

3. The invention of claim 1 further characterized by:

said planar light filtering panel being formed of a plurality of similar, arcuately shaped, light translucent, colored glass elements structurally joined by light opaque matrix material between the adjacent edges thereof.

4. The invention of claim 3 further characterized by:

the colored glass elements comprising the light filtering panel being arranged in adjacent spectral array with the violet-blue color forming the arcuately innermost element the violet-red color forming the arcuately outermost element.

5. The invention of claim 1 further characterized by:

the light filtering panel being supported on the bottom of the container and extending upwardly therefrom to a spaced distance from the top.

6. An article of manufacture which presents an optical image to a viewer simulating a containerized rainbow comprising, in combination:

a rigid peripherally defined bottle-like container having a frosted inner surface rendering it translucent to light, said container having a substantially vertical cylindrical body portion structurally carrying in the lower portion a bottom adapting the body for support on a planar surface and in the upper portion a transition element defining an orifice having means to fasten a top thereover;

a top adapted to be fastened over the orifice of the container to define an enclosed chamber therein; and a translucent light filtering panel structurally supported by said container to extend upwardly therein at a spaced distance from side of the cylindrical portion, said panel having a plurality of similar arcuately shaped multi-colored filtering elements arrayed in side to side adjacency in spectral order, said multi-colored filtering elements being structurally joined by optically opaque matrix material which prevents light from passing therebetween.

7. The invention of claim 6 further characterized by:

the top being releasably fastened to the transition element by the threaded means;

the translucent light filtering panel being structurally carried by the container bottom and extending upwardly therefrom to a spaced distance from the top; and the multi-colored filtering elements being arrayed in spectral order with violet-blue at the arcuately inner edge and violet-red at the arcuately outer edge.

* * * * *